United States Patent [19]

Groseth

[11] Patent Number: 4,772,981

[45] Date of Patent: Sep. 20, 1988

[54] MEANS FOR DIVERTING STATIC ELECTRICITY FROM A SITTING DEVICE SUCH AS AN OFFICE CHAIR

[76] Inventor: Morten Groseth, Bersvensasen 15, N-7460 Roros, Norway

[21] Appl. No.: 820,187

[22] Filed: Jan. 17, 1986

[30] Foreign Application Priority Data

Jun. 5, 1984 [NO] Norway ..... 842261
Jun. 3, 1985 [WO] PCT Int'l Appl. ..... PCT/NO85/00032

[51] Int. Cl.[4] ..... H05F 5/02
[52] U.S. Cl. ..... 361/212
[58] Field of Search ..... 361/212, 216, 220; 297/217, 219, 452

[56] References Cited

U.S. PATENT DOCUMENTS

| | | | |
|---|---|---|---|
| 1,744,004 | 1/1930 | Hunt | 361/217 |
| 2,802,148 | 8/1957 | Allder | 361/216 |
| 3,378,726 | 4/1968 | Lankow | 361/216 |
| 4,208,696 | 6/1980 | Lindsay et al. | 361/212 |
| 4,415,946 | 11/1983 | Pitts | 361/216 X |
| 4,491,894 | 1/1985 | Pitts | 361/216 |
| 4,513,347 | 4/1985 | Wilcox et al. | 361/220 X |
| 4,625,257 | 11/1986 | Lissner | 361/212 |
| 4,630,867 | 12/1986 | Gulliver | 361/212 X |

*Primary Examiner*—L. T. Hix
*Assistant Examiner*—Brian W. Brown
*Attorney, Agent, or Firm*—Darby & Darby

[57] ABSTRACT

Means in diverting static electricity from a sitting device, in which the supporting surfaces which are intended for support of a human body, in association with the upholstery is equipped with at least one electrically conducting layer which is electrically connected to earth, via the electrically conducting underframe of the sitting device. The electrically conducting layer may consist of a thin, preferably perforated plastic film, mat or net of electrically conducting material. The layer may be arranged on the upper surface of the upholstery and possibly be attached thereto, or be embedded therein.

11 Claims, 1 Drawing Sheet

MEANS FOR DIVERTING STATIC ELECTRICITY FROM A SITTING DEVICE SUCH AS AN OFFICE CHAIR

The present invention concerns a means for diverting static electricity from a sitting device such as an office chair.

When two materials in contact with each other are separated there is created an inbalance in the electrons on both surfaces with the result that one surface becomes positively charged (a lack of electrons) and the other surface becomes negatively charged (an excess of electrons). Because such a condition is unstable, each of the surfaces will try to return to a neutral condition through a discharge.

An an example there can be mentioned a person walking across the floor and thus creating a considerable charge. Experiments performed by T. S. Speakman at Western Electric Company gave the following illustrative results:

Accumulated charge on a person walking across the floor: normal value 12,000 volt; peak value 39,000 volt.

Accumulated charge on a person walking across a vinyl covered floor: normal 4,000 volt; peak value 13,000 volt.

Several factors interacted to change these values, e.g. relative humidity, ionization of the air, etc.

Many of the electronic components that are used in advanced office—and factory equipment are very sensitive to static electricity, both in connection with fields and discharges. VMOS circuits are sensitive for instance down to approximately 30 volts, MOSFET, EPROM and GaAsFET approximately 100 volts, CMOS approximately 250 volts etc.

Not only carpets can create electrostatic charges, but also plastic cups, cellophan paper, plastic maps and covers, paper, etc.

Except for the electronic components there are also within other areas a need to prevent a build up of electrostatic charges and discharges. There can be mentioned offshore, chemical-technical industry, mining and the like where an easily inflammable environment exists. Further the electrostatic fields from for instance computer terminals can result in headaches, fatigue as well as irritations of skin and eyes.

Accordingly the present invention aims to divert the electrostatic charge away from the person that is sitting in/on the sitting device as well as to discharge the field close to this device.

The device mentioned in the introduction is characterized by the features that are mentioned in the appendent patent claims.

The invention will be described with reference to the attached figures and it will be immediately understood that the prsent means may be used for all types of sitting devices and that the subsequently described design not is to be regarded as being limited to the design shown in the figures.

Figure 1:
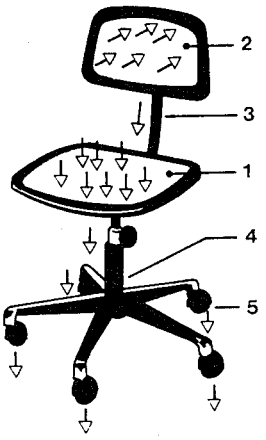
FIG. 1 illustrates how static electricity can be diverted entirely to the floor by means of the device according to the invention.

FIG. 1 shows a common office chair consisting of a seat 1 and a backrest 2. For simplicity reasons the chair is depicted without armrest. The depicted chair in FIG. 1 is intended as an example, and can be any sitting device, for instance of the type where the user is in a kneeling like position where the shin of the user is supported by a cushion.

As indicated in FIG. 1 static electricity that is accumulated on the body of the user will be discharged via the seat 1 and the backrest 2 as the connecting part 3 between the backrest and the seat is electrically conducting and the seat 1 is further connected with the underframe 4 of the chair also made of electrically conducting material and where the underframe may be equipped with castors 5 of electrically conducting materials for instance carbon containing plastic. The floor may by means per se known be connected to ground.

Figure 2:
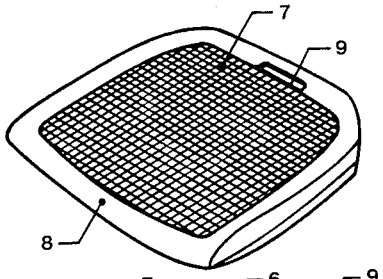
FIG. 2 illustrates a supporting surface for a sitting device, e.g. a seat, where the fabric normally covering the seat is not shown for the sake of simplicity.
Figure 3:
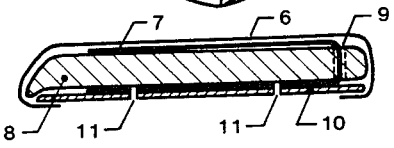
FIG. 3 shows a cross section of the seat in FIG. 2 with the covering fabric.

As suggested in FIG. 2 and 3 a thin plastic film or grid 7 consisting of electrically conducting material is placed beneath the fabric 6. The surface area of this conducting layer ought to be at least 80% of the contact surface area of the support device with the body. Perforated electrically conducting plastic film of a new quality will be advantageous since the material thereby will breathe and the electrical field will be increased at the edges whereby the effect is enhanced. The electrically conducting material mentioned is supported, as shown in FIG. 3, by padding 8 for example made of foam rubber.

The electrostatic discharge will be conducted through the fabric due to the proximity between the person and the conducting material, e.g. some sort of capacitive transfer. The conducting layer may then be connected through wires, metallic parts of the electrically conducting plastic components of the sitting device or the like to the floor or directly to ground.

In FIG. 2 and 3 there is suggested that the electrically conducting plastic film or grid 7 is led down through the padding 8 through a slot 9 therein, possibly around the foam rubber upholstery 8 and attached to the top side of a supporting plate 10 usually made of plywood by means of for example through claw nuts 11. Thereby the electrical charge from the top side of the textile will propagate through the conducting plastic and down to the nuts from which further electrical connection to ground may be brought about as suggested in connection with FIG. 1. An advantage by the present invention is that it is possible to use completely ordinary fabrics without use of any special treatment of these or the necessity of equipping them with metal treads or the like. The humidity given off from the body assists to a large extent to transfer the static electricity from the body to the electrically conducting material.

It will however immediately be understood that the electrically conducting material 7 need not necessarily consist of a perforated plastic film or grid, but may for instance be a web or a woven or a non-woven material. Further it will be understood that the electrically conducting layer may be casted in the padding 8 near the surface closest to the body of the user. The supporting plate 10 may be made of an electrically conducting plastic material. Further it is immediately understood that if it is inpractical that all parts in the underframe of a sitting device are metallic these may be made of electrically conducting plastic, for instance "nylon 12" from Chemische Werke Huls "Vestamid".

In the instance of a flooring with a high degree of isolating effect the sitting device ought to be placed on a electrically conducting grounded support. Such electrically conducting supports are for instance made by the firm "3M".

I claim:

1. A static electricity diverting device for use with a sitting device including a supporting surface, said supporting surface including a frame, padding means, and covering means, said diverting device comprising:

an electrically conductive, forminate, deformable plastic insert for use between the surface of said padding means and said covering means of said supporting means, said insert covering substantially all of the surface area of said supporting surface, and grounding means for electrically connecting said plastic insert to ground.

2. The static electricity diverting device of claim 1 wherein said supporting surface is the seat of a chair.

3. The static electricity diverting device of claim 1 wherein said supporting surface is the back rest of a chair.

4. The static electricity diverting device of claim 1 wherein said sitting device is electrically conductive and said grounding means electrically connects said diverting device to said sitting device.

5. A chair adapted to dissipate electrostatic charges which may be applied to said chair, said chair comprising:

an electrically conductive base portion for supporting said chair on a flat surface;

a seat mounted to said base portion, said seat including a frame, padding means, covering means and an electrically conductive, forminate, deformable plastic insert inserted between the surface of said padding means and said covering means ,said insert covering substantially all of the surface area of said seat; and electrical connecting means for connecting said plastic insert to said conductive base portion.

6. The chair according to claim 5 further comprising: a backrest mounted to said base portion, said backrest including a frame, padding means, covering means and an electrically conductive, perforated, deformable plastic insert inserted between the surface of said padding means and said covering means; and electrical connecting means for connecting said plastic insert to said conductive base portion.

7. The chair according to claim 5 further comprising electrically conductive castors for supporting said base portion.

8. The chair according to claim 5 wherein said covering means is fabric.

9. The chair according to claim 5 wherein said padding means is foam rubber.

10. The chair of claim 5 wherein said insert is inserted between said seat frame and the lower surface of said padding means and extends over the upper surface of said padding means.

11. The chair of claim 10 wherein said insert is electrically connected to said seat frame, and said seat frame is electrically connected to said conductive base portion.

* * * * *